US009705184B2

(12) United States Patent
Randjelovic et al.

(10) Patent No.: US 9,705,184 B2
(45) Date of Patent: Jul. 11, 2017

(54) ANTENNA ASSEMBLY FOR A TIME-PIECE

(71) Applicant: THE SWATCH GROUP RESEARCH AND DEVELOPMENT LTD, Marin (CH)

(72) Inventors: Zoran Randjelovic, Corcelles (CH); Jean-Daniel Etienne, Les Geneveys-sur-Coffrane (CH); Matthieu Grange, Boudry (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/649,078

(22) PCT Filed: Nov. 28, 2013

(86) PCT No.: PCT/EP2013/075023
§ 371 (c)(1),
(2) Date: Jun. 2, 2015

(87) PCT Pub. No.: WO2014/095298
PCT Pub. Date: Jun. 26, 2014

(65) Prior Publication Data

US 2015/0325905 A1 Nov. 12, 2015

(30) Foreign Application Priority Data

Dec. 21, 2012 (EP) ..... 12199182

(51) Int. Cl.
*H01Q 1/12* (2006.01)
*H01Q 1/27* (2006.01)
(Continued)

(52) U.S. Cl.
CPC ..... *H01Q 1/273* (2013.01); *G04G 17/04* (2013.01); *G04G 17/06* (2013.01); *H01Q 1/241* (2013.01);
(Continued)

(58) Field of Classification Search
CPC ..... H05K 1/02; B32B 38/18; H01Q 1/273; H01Q 1/241
(Continued)

(56) References Cited

U.S. PATENT DOCUMENTS 4,884,252 A 11/1989 Teodoridis et al.
5,846,094 A 12/1998 Murray et al.
(Continued)

FOREIGN PATENT DOCUMENTS

EP 0 339 482 A1 11/1989
EP 2 071 669 A2 6/2009
EP 2 615 685 7/2013

OTHER PUBLICATIONS

International Search Report issued Mar. 19, 2014, in PCT/EP2013/075023, filed Nov. 28, 2013.
(Continued)

*Primary Examiner* — Peguy Jean Pierre
(74) *Attorney, Agent, or Firm* — Oblon, McClelland, Maier & Neustadt, L.L.P.

(57) ABSTRACT

An antenna assembly for a mobile device comprising a printed circuit board and an antenna structure located at a distance from the printed circuit board. The antenna structure is electrically connected to the printed circuit board via at least one elastomeric connector comprising a plurality of conductive filaments and an insulating structure extending between the antenna structure and the printed circuit board.

15 Claims, 2 Drawing Sheets

(51) Int. Cl.

| | |
|---|---|
| ***G04G 17/04*** | (2006.01) |
| ***G04G 17/06*** | (2006.01) |
| ***H01Q 1/24*** | (2006.01) |
| ***H01R 13/24*** | (2006.01) |
| *H01R 12/52* | (2011.01) |

(52) U.S. Cl.
CPC ..... *H01R 13/2414* (2013.01); *H01R 12/52* (2013.01); *H01R 2201/02* (2013.01)

(58) Field of Classification Search
USPC ..... 343/718, 700 MS, 702, 700
See application file for complete search history.

(56) References Cited

U.S. PATENT DOCUMENTS

| | | | | |
|---|---|---|---|---|
| 5,927,997 | A | 7/1999 | Ruland et al. | |
| 6,018,326 | A * | 1/2000 | Rudisill | H01Q 1/084 29/600 |
| 7,746,280 | B2 * | 6/2010 | Kim | H01Q 1/243 343/700 MS |
| 8,587,485 | B2 * | 11/2013 | Tahk | H01Q 1/243 343/702 |
| 2001/0029119 | A1 | 10/2001 | Chung | |
| 2009/0153426 | A1 | 6/2009 | Worl et al. | |
| 2012/0119962 | A1 | 5/2012 | Irie | |
| 2013/0048347 | A1 * | 2/2013 | Shiu | H05K 1/028 174/254 |
| 2015/0316896 | A1 * | 11/2015 | Balmer | G04G 17/06 368/316 |

OTHER PUBLICATIONS

International Preliminary Report on Patentability issued Mar. 24, 2015 in PCT/EP2013/075023, filed Nov. 28, 2013.

* cited by examiner

ANTENNA ASSEMBLY FOR A TIME-PIECE

CROSS-REFERENCE TO RELATED APPLICATIONS

This is a United States National Phase application of International patent application PCT/EP2013/075023 filed Nov. 28, 2013 which claims priority on European patent application 12199182.2 of Dec. 21, 2012. The entire disclosures of the above patent applications are hereby incorporated herein by reference.

FIELD OF THE INVENTION

The present invention relates to an antenna assembly for a time-piece and in particular to an antenna assembly for receiving radio frequency (RF) signals.

BACKGROUND AND PRIOR ART

Implementation of RF antennas in mobile devices, such like mobile phones, tablet computers or time-pieces, such like wrist watches is quite cumbersome and elaborate. Especially when the housing of the mobile device is made of metal or comprises metallic components, such like stainless steel arranging of an antenna in a metallic housing is somewhat critical since the housing may effectively serve as a Faraday cage.

There exist already some approaches to provide the antenna on a cover glass, for instance on a watch glass. But here, electrical connection between the antenna and a printed circuit board (PCB) may be disadvantageous in view of the high frequency or RF frequency behaviour of the antenna assembly. The interconnection between the PCB and the antenna is rather critical since the type of interconnection may impair or deteriorate the impedance and the signal receiving capability of the antenna assembly.

Moreover, connecting the antenna with the PCB is quite complex, intricate and sensitive when assembling a watch or a respective mobile device. Especially in a mass manufacturing process it is quite difficult to produce antenna-PCB interconnections with consistent quality.

It is therefore an object of the present invention to provide an improved antenna assembly with a printed circuit board (PCB) for a mobile device. In particular, the invention should provide a well-defined interconnection between an antenna structure and the PCB, which allows for an easy, intuitive and precise electrical interconnection therebetween. Moreover, the invention is adapted to provide a highly redundant antenna assembly allowing and tolerating for a certain degree of special mismatch when arranging the antenna and the PCB in a housing of the mobile device. In a further aspect, the invention aims to provide a cost efficient and durable interconnection for an antenna structure and a PCB in mobile devices, such like a time-piece, in particular for a wristwatch.

SUMMARY OF THE INVENTION

In a first aspect, the invention relates to an antenna assembly for a mobile device, in particular for a time-piece. The mobile device comprises a printed circuit board (PCB). The antenna assembly comprises an antenna structure located at a distance from the printed circuit board. The antenna structure is electrically connected to the PCB via at least one elastomeric connector comprising a plurality of conductive filaments and insulating filaments extending between the antenna structure and the PCB.

By means of at least one elastomeric connector, also commonly denoted as ZEBRA-connector, a highly redundant, elastic and rather precise electrical interconnection between the PCB and the antenna structure can be provided. By means of the at least one elastomeric connector respective connecting portions of the antenna structure and the PCB can be electrically connected by means of a plurality of conductive filaments of the elastomeric connector.

In this way, a rather efficient, tolerance compensating and highly reliable electrical interconnection between the antenna structure and the PCB can be provided.

Typically, the elastomeric connector directly interconnects respective connecting portions of the PCB and the antenna structure, respectively, simply by means of being sandwiched there between. The electrical interconnection between the antenna structure and the PCB can therefore be rather simply obtained by arranging the at least one elastomeric connector between the preferably planar surfaces of the antenna structure and the PCB.

Here, it is of further benefit when surrounding components, such like a casing, housing, or cover glass are mechanically engaged to keep the antenna structure, the PCB and the elastomeric connector extending therebetween in a mutual abutment configuration. In this way, a reliable, robust, and rather durable electric interconnection between the antenna structure and the PCB can be provided.

In a preferred embodiment, the elastomeric connector comprises numerous regularly arranged conductive filaments embedded in an insulating elastomeric material. Here, the insulating material may not only comprise insulating filaments but may comprise a bulk material structure through which numerous conductive filaments extend. The elastomeric material may be based on a natural or synthetic rubber material while the conductive elements may comprise silver filaments or gold filaments. It is also conceivable that the conductive elements are made of some other kind of conductive material, such like copper or alloys featuring a comparable electric conductivity.

Typically, the conductive filaments extend parallel to each other and may be oriented substantially perpendicular to the plane of the PCB and/or the antenna structure. In this way, the overall length of the elastomeric connector can be kept at a minimum. Preferably, the elastomeric connector comprises a plurality of conductive filaments in order to provide an inherent redundancy.

In an interconnecting configuration with either the PCB or the antenna structure it is sufficient, when at least some of the numerous conductive filaments get in direct mechanical and hence electrical contact with a respective connecting portion of either the PCB or the antenna structure. In this way, geometrical tolerances of the antenna structure, of the PCB and their mutual arrangement inside the housing of the mobile device or time-piece can be easily compensated.

According to another preferred embodiment the elastomeric connector comprises rubberized layers of alternating conductive and insulating materials. Since the elastomeric connector comprises rubberized layers, the entire elastomeric connector may provide a certain degree of flexibility, by way of which the elastomeric connector may be easily implemented in shock and anti-vibration applications. Generally, the elastomeric connector may even create a gasket-like seal between the antenna structure and the PCB for rather harsh environments.

Each of the conductive filaments of the elastomeric connector provides an electrical path connected with the antenna structure and the PCB with opposite ends.

In another preferred embodiment, the antenna structure and/or PCB comprises at least one connecting portion with a cross-section substantially smaller than a transverse extension of the at least one elastomeric connector extending therebetween. In the present context, the transverse extension refers to the direction extending substantially perpendicular to the distance between the antenna structure and the PCB or substantially perpendicular to the elongation of the conductive filaments of the elastomeric connector.

Since the transverse extension of the elastomeric connector is substantially larger than the at least one connecting portion of the PCB or of the antenna structure, a certain spatial and transverse mismatch regarding the mutual alignment of the antenna structure, the PCB and the elastomeric connector can be easily compensated.

Only those conductive filaments of the elastomeric connector extending between the connecting portions of PCB and the antenna structure will serve to provide an electrical interconnection therebetween while other redundant filaments of the elastomeric connector may be positioned outside the connecting portions of either the PCB or the antenna structure. Since the lateral or transverse cross-section of the at least one elastomeric connector may be larger than the lateral size or cross-section of the connecting portions of PCB and/or antenna structure a sufficient electrical interconnection between PCB and antenna structure will be provided in any way, even when the elastomeric connector is positioned slightly offset but still at least partially overlapping with respective disconnecting portions of the PCB or the antenna structure, respectively.

In a further preferred embodiment, the elastomeric connector is integrated into a spacer structure extending between the antenna structure and the PCB. The spacer structure may for instance comprise an annular geometry and may fill or surround the space between the PCB and the antenna structure. The spacer structure may therefore effectively fill a gap between the PCB and the antenna structure.

Moreover, the spacer may provide sufficient stability and rigidity to the elastomeric connector. Especially by embedding the elastomeric connector into the spacer structure, the spacer structure itself may provide an electrical interconnect between the antenna structure and the PCB. Preferably, the spacer structure comprises an elastomeric material, such like a natural or synthetic rubber, which may be identical or different to the elastomeric material of the elastomeric connector extending between the conductive filaments thereof.

Embedding the elastomeric connector in a spacer structure is of particular advantage for assembling of the elastomeric connector between the PCB and the antenna structure. In this regard, the spacer structure should only be oriented in a well-defined way between the PCB and the antenna structure in order to at least partially overlap with the connecting portions of the antenna structure and the PCB, respectively.

According to another embodiment the antenna assembly comprises at least two separate elastomeric connectors, each of which extending between first and second connecting portions of the antenna structure and the PCB, respectively.

Additionally or alternatively, the two separate elastomeric connectors may be incorporated into one extended elastomeric connector structure. Since the various and substantially parallel oriented conducting filaments of the elastomeric connector are electrically insulated, the elastomeric connector only provides redundant and multiple electrical interconnections between connecting portions of the antenna structure and the PCB by means of separate conductive filaments.

In practical situations, such filaments of the elastomeric connector located laterally or transversally offset from connecting portions of the antenna structure or the PCB are somewhat functionless and are hence entirely redundant. However, this redundancy is of particular benefit in terms of compensating eventual spatial manufacturing or assembly tolerances.

In another embodiment, the conductive filaments comprise a diameter between 50 μm and 150 μm. Preferably, the diameter of the conductive filaments ranges between 80 μm and 120 μm and more preferably, the diameter of the filaments may be around 100 μm. Additionally, mutually adjacently located conductive filaments of the elastomeric connector are separated from each other by at least a distance of 70 μm, preferably by a distance of at least 100 μm or by a distance of at least 130 μm, 150 μm or even more.

In this way, a rather densely packed structure of separate electrically insulating filaments can be provided allowing to interconnect selected connecting portions of the antenna structure and the PCB, that feature a cross-section or diameter in the range of a few millimeters or even in the range of less than one millimeter.

In a further embodiment, the conductive filaments of the elastomeric connector form a part of the antenna structure. Since the distance between the preferably planar-shaped antenna structure and the PCB may be non-negligible in terms of the antenna's impedance or high frequency behaviour, it is of particular benefit when the overall geometric and electric design of the antenna structure and the elastomeric connector mutually complement to match with a predefined antenna design.

In this way, the elastomeric connector together with the substantially planar-shaped antenna structure may constitute the antenna assembly for mobile devices, such like timepieces.

In a further preferred embodiment, the filaments of the elastomeric connector extend substantially perpendicular to the plane of the PCB and/or to the plane of the antenna structure. In this configuration the mutually corresponding connecting portions of the antenna structure and the PCB substantially overlap as seen along the surface normal of PCB and antenna structure, respectively.

By orienting the conductive filaments of the elastomeric connector substantially perpendicular to the plane of the PCB and/or of the antenna structure, the overall length of the elastomeric connector can be kept to a minimum.

Alternatively it is also conceivable, that the filaments of the elastomeric connector extend at a certain or predefined angle relative to the surface normal of the PCB or the antenna structure. In such a configuration it is even conceivable that the elastomeric connector even serves to electrically interconnect connecting portions of PCB and antenna structure that do only partially overlap or that do not overlap at all as seen in a direction perpendicular to the plane of the PCB or of the antenna structure.

According to another aspect, the antenna structure is coated on a planar substrate formed by a cover glass or by a watch glass. By providing a substantially translucent or transparent antenna on a cover glass or on a watch glass, e.g. comprising or consisting of sapphire, the antenna can be arranged effectively outside a metallic region of e.g. a housing of the mobile device. Preferably, the antenna structure is laminated or coated, e.g. sputtered on an inside facing portion of the cover glass or watch glass.

According to another embodiment, the antenna structure may comprise a monopole antenna or a planar inverted F-antenna (PIFA). When implemented as a monopole antenna, the antenna structure extending across the planar substrate may be connected with only one connecting portion with the RCB while another antenna portion may be provided by a housing component, such like a ground connection of e.g. a metallic watch case.

In a further preferred embodiment, the antenna structure comprises a transparent conductive oxide structure (TCO) coated on an inside portion of a watch glass. Here, the antenna structure is substantially optically transparent, at least in the visible spectral range and may therefore comprise a transparent conductive oxide layer (TCO). Hence, the antenna structure may comprise materials such like indium tin oxide (ITO) or the like.

Moreover and according to another embodiment, at least one further touch sensitive sensor structure is provided on the planar substrate, on which the antenna structure is located or coated. In this way, the planar substrate, e.g. a watch glass, e.g. a sapphire substrate may provide a basis for the antenna structure as well as for further sensor components to be equally electrically connected to the PCB. Hence, the elastomeric connector may not only serve to electrically interconnect the antenna structure with the PCB but also additional touch sensitive sensor structures that are also provided on a planar substrate.

In still another aspect, the invention also relates to a watch or to a time-piece comprising a movement featuring a printed circuit board and further comprising at least one antenna assembly as described above.

BRIEF DESCRIPTION OF THE DRAWINGS

In the following, preferred embodiments of the invention will be described by making reference to the drawings, in which.

DETAILED DESCRIPTION

Figure 1:
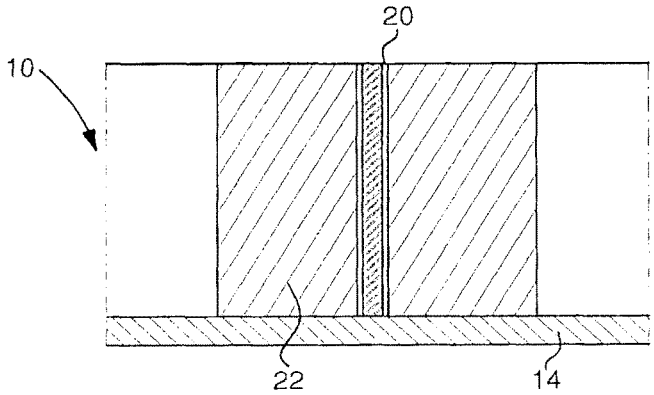
FIG. 1 shows a side view of the antenna assembly according to a first embodiment.
Figure 2:
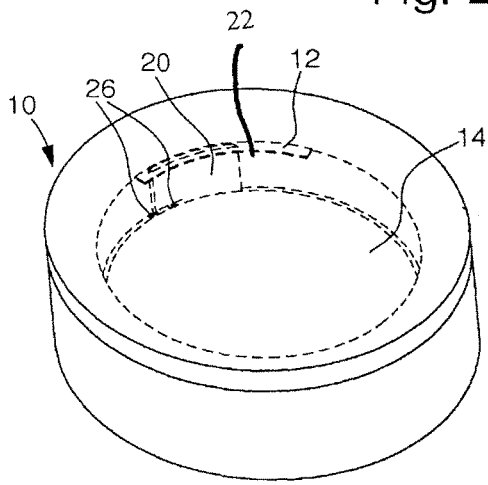
FIG. 2 shows a perspective illustration of the antenna arranged according to FIG. 1.
Figure 3:
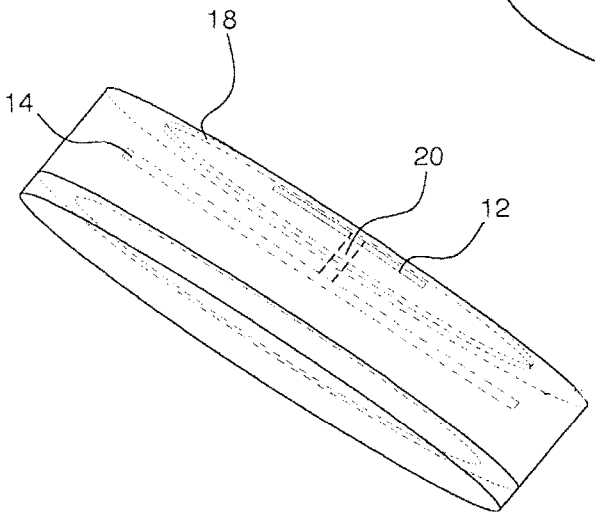
FIG. 3 is indicative of a partially transparent and perspective view of the antenna structure, FIG. 4 schematically illustrates an enlarged view of the various filaments of an elastomeric connector extending between the antenna structure and the PCB.

Throughout the FIGS. 1 to 4 an antenna assembly 10 is illustrated featuring an antenna structure 12, such like an inverted F-antenna as for instance illustrated in FIG. 2. The antenna structure 12 comprises an arc-shaped structure coated on an inside facing portion of a substrate 18. The substrate 18 may typically comprise or may implemented as a cover glass or watch glass serving to seal the housing of a mobile device, in particular of a time-piece. The substrate may for instance comprise or may consist of sapphire or hard-coated glass.

The antenna assembly 10 as illustrated in FIGS. 1 to 4 further comprises a spacer structure 22 by way of which the substrate 18 featuring the antenna structure 12 can be kept at a predefined distance from a printed circuit board 14 located on a respective substrate 16.

Preferably, the elastomeric connector 20 extends between the substrates 16, 18 in a mutually and mechanically contacting way so as to provide an electrical interconnect between connecting portions 26 of the PCB and respective connecting portion 36 of the antenna structure 12 or 32. By means of the spacer structure 22, the substrate 18 of the antenna structure 12 and the substrate 16 providing the PCB can be kept at a predefined distance.

Moreover, the annular or cylindrically shaped spacer structure, which may generally comprise any arbitrary geometrical shape serves to effectively embed the elastomeric connector 20 therein. Hence, the elastomeric connector 20 or the various elastomeric connectors 20 as for instance illustrated in FIGS. 2 to 4 can be mechanically supported by the spacer structure 22. By means of the spacer structure 22, the substrate 16 and the substrate 18 can be kept in a constrained arrangement. For instance by applying pressure or thrust in direction of the surface normal of substrate 16 and/or of substrate 18 said two substrates 16, 18 can be kept in a well defined orientation and in a mechanically engaged configuration.

It is then due to the spacer structure 22 that the elastomeric connector 20 or that various elastomeric connectors 20 may effectively maintain their shape as well as their electrical conductive or electrically insulating properties.

Figure 4:
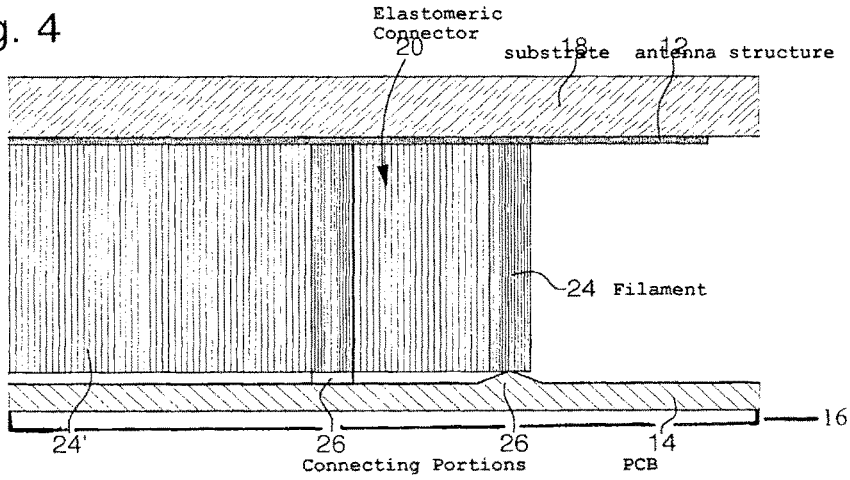

As shown in detail in FIG. 4 the elastomeric connectors 20 comprise numerous parallel oriented filaments 24 extending substantially perpendicularly between the planar oriented antenna structure 12 and the PCB 14 located at a particular distance therefrom.

As illustrated in FIG. 4 in detail there exist substantially electrically active filaments 24, which effectively overlap and which directly electrically and mechanically engage with connecting portions 26 provided on the PCB. Apart from these active filaments 24 there are provided numerous inactive and hence redundant conductive filaments 24' extending in a space between the two connecting portions 26 of the printed circuit board 14.

By providing a particular sidewall section of the spacer structure 22 with an elastomeric connector 20, even a positional mismatch between the antenna structure 12, the PCB 14 and the spacer structure 22 extending therebetween may be effectively tolerated to a certain extend. In this way, a rather intuitive and tolerance compensating mutual assembly of the two substrates 16, 18 and the spacer structure 22 featuring at least one elastomeric connector 20 therein can be facilitated.

Figure 5:
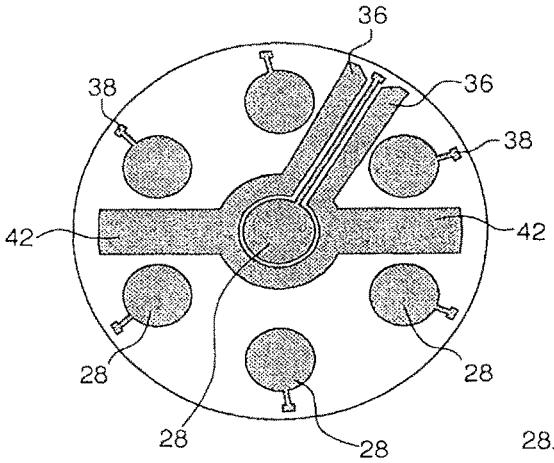
FIG. 5 schematically illustrates a planar view of the antenna structure together with an additional sensor structure on a common planar substrate and FIG. 6 is illustrative of another embodiment of an antenna structure featuring a monopole antenna.

In FIG. 5 one example of a PIFA antenna structure 12 is given featuring two radially outwardly extending connecting portions 36, each of which adapted to be separately connected with corresponding connecting portions 26 of the PCB 14, as for instance illustrated in FIG. 4. Here, and by arranging at least one elastomeric connector 20 between the antenna structure 42 and a PCB substrate 16 located underneath, respective connecting portion 36 of the antenna structure 42 and the connecting portion 26 of the PCB 14 can be separately interconnected.

Moreover, the antenna substrate 18 as indicated in FIG. 5 may not only be provided with an transparent antenna structure 42 but may also comprise numerous sensor structures 28, each of which being provided with a separate connecting portion 38 circumferentially and adjacently located to the connecting portions 36 of the antenna structure 42.

By providing at least one elastomeric connector 20 all the way at least along such an outer circumference, which matches or corresponds with the region in which the various connecting portions 36, 38 of the antenna assembly 42 and the sensor structures 28 are located a multiple electrical interconnection of the various connecting portions 36, 38 with the PCB can be inherently obtained. Here, by arranging a single elastomeric connector 20 between the antenna substrate 18 and the substrate 16 on which the PCB 14 is located, several and separate isolated interconnections of the various components 36, 38 provided on the antenna substrate 18 with the PCB 14 can be established in a single step.

Figure 6:
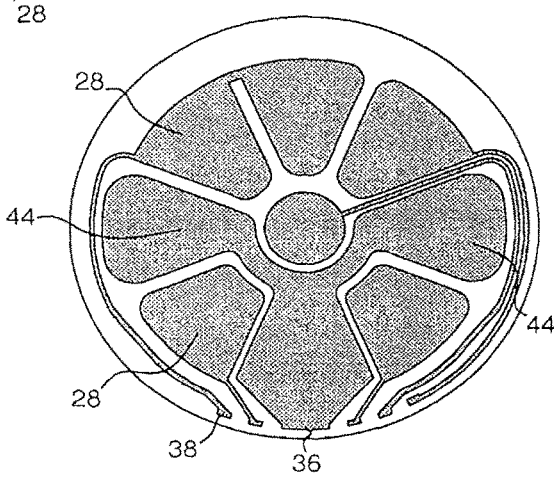

FIG. 6 is finally illustrative of another antenna structure 44 featuring a monopole antenna comprising numerous radially outwardly extending lobes. As illustrated in FIG. 6 a central lobe, pointing towards 6'o clock, when interpreting the antenna structure with a watch configuration, is electrically connected to a PCB 14 located underneath. Here, the antenna structure 44 is preferably implemented as a monopole antenna, wherein another part or portion of the antenna is typically provided by a housing or by a housing component of the mobile device, e.g. by the housing of a timepiece. Also in FIG. 6 the substrate 18 is not only provided with a substantially transparent antenna structure 42 but additionally comprises a series of touch sensitive sensors 38.

Also here, the various sensors or sensor portions 28 are provided with comparatively filigree conductive structures extending towards a radially outwardly located rim of the substrate 18 to electrically and/or mechanically engage with an elastomeric connector 20 of respective shape and dimensions.

LIST OF REFERENCE NUMERALS

10 antenna assembly
12 antenna structure
14 printed circuit board (PCB)
16 substrate of PCB
18 substrate of the Antenna
20 elastomeric connector
22 spacer structure
24 filament
26 connecting portion
28 sensor structure
32 antenna structure
36 connecting portion of the Antenna
38 connecting portion of other sensors
42 antenna structure
44 antenna structure

The invention claimed is:

1. An antenna assembly for a mobile device comprising:
a printed circuit board and an antenna structure separated by a spacer from the printed circuit board,
wherein the antenna structure is electrically connected to the printed circuit board via at least one elastomeric connector comprising a plurality of conductive filaments and insulating structure extending between the antenna structure and the printed circuit board,
wherein the antenna structure comprises a conductive coating on a planar substrate,
wherein at least one further sensor component comprising a conductive coating is provided on the planar substrate along with the antenna structure,
wherein said elastomeric connector also connects said at least one further sensor component to said printed circuit board, and
wherein the elastomeric connector comprises regularly arranged conductive filaments embedded in an insulating elastomeric material.

2. The antenna assembly according to claim 1, wherein the elastomeric connector comprises rubberized layers of alternating conductive and insulation materials.

3. The antenna assembly according to claim 1, wherein the antenna structure and/or the PCB comprise at least one connecting portion with a cross-section smaller than a transverse extension of the at least one elastomeric connector.

4. The antenna assembly according to claim 1, wherein the elastomeric connector is integrated into a spacer structure extending between the antenna structure and the printing circuit board.

5. The antenna assembly according to claim 3, wherein at least two separate elastomeric connectors are provided, each of which extending between the first and the second connecting portions of the antenna structure and the printed circuit board, respectively.

6. The antenna assembly according to claim 1, wherein the conductive filaments of the elastomeric connector comprise a diameter between 50 μm and 150 μm and wherein adjacently located conductive filaments are separated from each other by at least a distance of 70 μm to 150 μm, or by a distance of around 100 μm.

7. The antenna assembly according to claim 1, wherein the conductive filaments of the elastomeric connector is arranged to complement with the antenna structure to match with a predefined antenna design.

8. The antenna assembly according to claim 1, wherein the filaments of the elastomeric connector extends substantially perpendicular to the plane of the printed circuit board and/or to the plane of the antenna structure substrate.

9. The antenna assembly according to claim 1, wherein the planar substrate is a watch glass.

10. The antenna assembly according to claim 9, wherein said at least one further sensor component is a touch sensitive sensor structure.

11. The antenna assembly according to claim 1, wherein the antenna structure comprises a monopole antenna, or a planar inverted F-antenna.

12. The antenna assembly according to claim 1, wherein the antenna structure comprises a transparent conductive oxide coating provided on an inside portion of a watch glass.

13. A watch comprising a movement and a housing and further comprising an antenna assembly according to claim 1.

14. An antenna assembly for a mobile device comprising:
a printed circuit board and an antenna structure separated from the printed circuit board,
wherein the antenna structure is electrically connected to the printed circuit board via at least one elastomeric connector comprising a plurality of conductive filaments and insulating structure extending between the antenna structure and the printed circuit board,
wherein the antenna structure comprises a conductive coating on a planar substrate,
wherein at least one further sensor component comprising a conductive coating is provided on the planar substrate along with the antenna structure,
wherein said elastomeric connector also connects said at least one further sensor component to said printed circuit board, and wherein the elastomeric connector comprises numerous regularly arranged conductive filaments embedded in an insulating elastomeric material.

15. An antenna assembly for a mobile device comprising:

a printed circuit board and an antenna structure separated from the printed circuit board, wherein the antenna structure is electrically connected to the printed circuit board via at least one elastomeric connector comprising a plurality of conductive filaments and insulating structure extending between the antenna structure and the printed circuit board, wherein the antenna structure comprises a conductive coating on a planar substrate, wherein at least one further sensor component comprising a conductive coating is provided on the planar substrate along with the antenna structure, wherein said elastomeric connector also connects said at least one further sensor component to said printed circuit board, and wherein the elastomeric connector includes at least two conductive filaments embedded in elastomeric material.

* * * * *